US006722717B2

(12) United States Patent
Kuhnke

(10) Patent No.: US 6,722,717 B2
(45) Date of Patent: Apr. 20, 2004

(54) DISTANCE-VARIABLE CLOSING STIRRUP FOR ROTARY-LATCH LOCKS

(75) Inventor: Frank Kuhnke, Essen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/344,830

(22) PCT Filed: Aug. 9, 2001

(86) PCT No.: PCT/EP01/09201

§ 371 (c)(1),
(2), (4) Date: Feb. 14, 2003

(87) PCT Pub. No.: WO02/16717

PCT Pub. Date: Feb. 28, 2002

(65) Prior Publication Data

US 2003/0164617 A1 Sep. 4, 2003

(30) Foreign Application Priority Data

Aug. 22, 2000 (DE) ..... 100 41 652

(51) Int. Cl.[7] ..... E05B 15/02

(52) U.S. Cl. ..... 292/341.18; 292/DIG. 60; 292/341.15

(58) Field of Search ..... 292/340, 341.12, 292/341.13, 341.15, 341.16, 341.17, 341.18, 341.19, DIG. 60

(56) References Cited

U.S. PATENT DOCUMENTS 2,089,163 A * 8/1937 Hansen ..... 292/340
2,712,955 A * 7/1955 Andrews ..... 292/113
3,664,696 A * 5/1972 Poe ..... 292/26
4,130,260 A * 12/1978 Poe ..... 244/129.5
4,220,364 A 9/1980 Poe
4,451,071 A 5/1984 Striese et al.
4,798,408 A * 1/1989 Harmon et al. ..... 292/341.18
4,852,923 A 8/1989 Harmon et al.

* cited by examiner

*Primary Examiner*—Gary Estremsky
(74) *Attorney, Agent, or Firm*—Friedrich Kueffner

(57) ABSTRACT

The invention relates to a rotary-latch lock comprising two additional parts, namely a closing stirrup (10) and at least one rotary latch. The lock is adjusted by means of the assembly of the closing stirrup. Said rotary latch is arranged on a flap element, for example, in a fixed manner, and remains in such a position. The closing stirrup (10) is then placed on a body part, for example, in such a way that the position thereof can be changed by means of, for example, spacer sleeves or spacer bars. The aim of the invention is to create a reliable lock which can be easily adjusted after being assembled. In order to achieve this, the closing stirrup (10) comprises two components, namely a fixing element (11) and a stirrup element (19). The two components (11, 19) are arranged in a distance-variable manner in such a way that the stirrup element (10) can be connected to the body part by means of the fixing element (11), and the lock is adjusted after assembly by changing the distance between the two components (11, 19). A regulating element (28) for changing the distance is arranged between the fixing element (11) and the stirrup element (19).

9 Claims, 3 Drawing Sheets

DISTANCE-VARIABLE CLOSING STIRRUP FOR ROTARY-LATCH LOCKS

The invention pertains to a lock of the type indicated in the introductory clause of Claim 1. So that the closing stirrup seated on the one part can be adjusted with respect to the locking element attached to the other part, the closing stirrup consists of two distance-variable components. The one component is fastened to the one part and is therefore referred to as the "fastening element". The other component has a "stirrup element", which has not only a web but also two sidepieces, which are parallel to each other. A regulating element, which consists of a setscrew, is used to adjust the distance; the actuating point of this element is easily accessible from the area of the web of the stirrup. The setscrew has a right-handed and a left-handed external thread, and corresponding internal threads complementary to these are provided in the two components.

The known lock of this type (U.S. Pat. No. 4,220,364 A) is used to attach panels in aircraft. The fastening element consists of two stationary guide sleeves in the panel frame, spaced a certain distance apart, in which the two sidepieces of the associated stirrup element are longitudinally guided. The ends of the two sidepieces are connected by a rung, in which one of the internal threads for the setscrew is provided. This rung is located on the side of the stirrup web (i.e., the web which cooperates with the locking element) which is opposite the side on which the two guide sleeves seated in the panel frame are located. The other internal thread for the setscrew is located between the guide sleeves. The setscrew is located in the same plane as the two stirrup sidepieces, for which reason its actuating point is aligned with the stirrup web and is therefore difficult to access for actuation. Another disadvantage is that the setscrew can shift in an uncontrolled manner in the two internal threads, as a result of which the distance between the two components changes. This lock cannot be used for the flaps of automotive body parts.

Distance-variable closing stirrups are also known in locks of a different type. In one case (U.S. Pat. No. 4,852,923 A), a rotationally actuatable worm and a worm gear, which engages with a threaded shaft, are used as the regulating means. The threaded shaft is permanently connected to the closing stirrup. This lock is bulky and requires expensive components.

The locking plate which works together with a flap locking bar of another, different type of lock (U.S. Pat. No. 4,451,071 A) is designed as an L-shaped piece of metal sheet or plate. Whereas the one sidepiece of the L has an opening which cooperates with the locking bar, the other sidepiece of the L is guided with freedom of longitudinal movement in a base attached to the flap and has a linear row of parallel slots extending transversely to the direction of displacement. These slots engage in the threads of a screw, which is supported rotatably in the base. The actuating end of this screw projects out from the base next to the locking plate. As a result, the unit is quite tall. The screw thread does not always engage reliably in the slots, for which reason a spring-loaded pin is provided to improve the engagement. The screw cannot permanently secure the position of the locking plate after the plate has been adjusted.

The invention is based on the task of developing a reliable lock of the type indicated in the introductory clause of Claim 1 which is easy to adjust after installation. This is achieved according to the invention by the measures listed in the characterizing clause of Claim 1, to which the following special meaning attaches:

In addition to the setscrew, the invention also uses another screw between the stirrup element and the fastening element; after the setscrew has been adjusted, the additional screw creates pretension between these two components. As a result of this pretension, the adjusted distance is locked in. This screw therefore serves as a securing element for a defined position of the stirrup web with respect to the lock element cooperating with it. A rotary latch can be used as the lock element. From the perspective of the web, the stirrup element is located between the guides in front of the fastening element. The fastening element has fastening points at the base so that it can be attached to one of the two parts, which consist here of a flap part and a body part. The actuating point of the setscrew and the actuating point of the screw functioning as a securing element can be on opposite sides of the distance-variable web and are therefore always easy to access for the adjustment and locking-in operations.

Additional measures and advantages of the invention can be derived from the subclaims, from the following description, and from the drawings. The drawings present the invention on the basis of an exemplary embodiment:

The lock connects, for example, a movable flap part to a stationary body part. For this purpose, it consists, first, of a rotary latch on, for example, the flap part and a closing stirrup 10 on, for example, the stationary body part. When the rotary latch is engaged with the closing stirrup 10, the stationary body part is connected to the movable flap part by the lock. It is of no importance to the lock whether the rotary latch is attached to the flap part and the closing stirrup 10 to the stationary body part or the rotary latch to the stationary body part and the closing stirrup 10 to the flap part.

Figure 3:
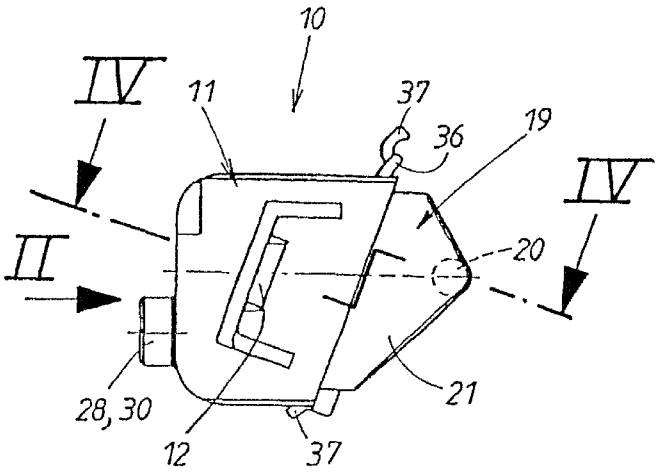
FIG. 3 shows a side view of the closing stirrup of FIG. 1 with the cover attached.
Figure 1:
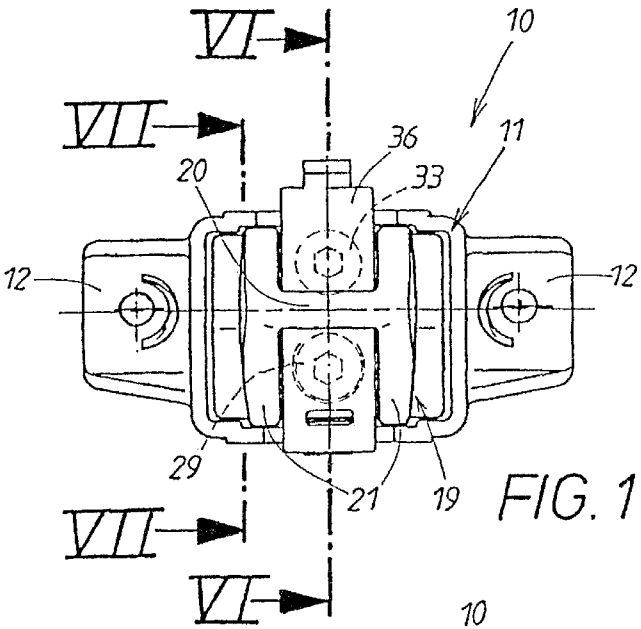
FIG. 1 is a top view of a closing stirrup with a cover for the regulating and securing elements.

The closing stirrup 10 consists, first, of two parallel sidepieces 21, between which there is at least one web 20, and, second, of fastening points 12. So that the closing stirrup 10 can still be adjusted after it has been installed, it consists of two distance-variable components, namely, a fastening element 11 with the fastening points 12 and a stirrup element 19 with at least one web 20 and the parallel stirrup sidepieces 21. So that the distance between the fastening element 11 and the stirrup element 19 can be changed, a regulating element 28 is also provided between the two components. FIG. 1 shows a top view of the closing stirrup 10 with its two components, the fastening element 11 and the stirrup element 19.

As can also be seen in FIG. 1, the fastening points 12 in the exemplary embodiment shown are provided on the sides of the fastening element 11, on the axis of the web 20. The fastening points 12 can thus be easily hidden by a lining 38 after installation. Of course, the fastening points 12 could also be located above and below or elsewhere on the fastening element 11.

Figure 2:
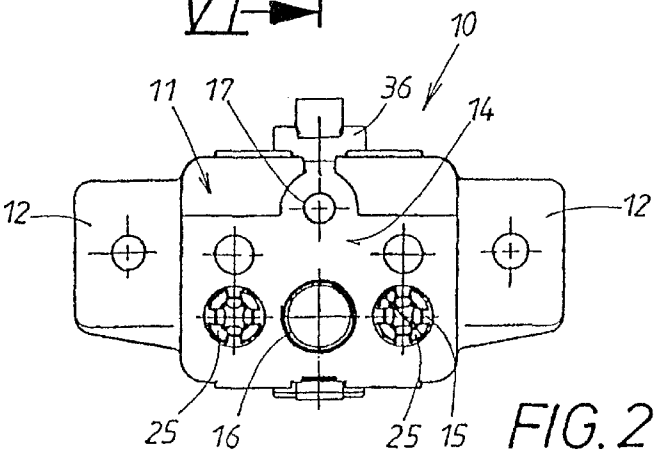
FIG. 2 shows the rear of the closing stirrup according to FIG. 1 with the cover attached.

So that the lock can be easily adjusted after the rotary latch and the closing stirrup 10 have been installed, an actuating point 29 of the regulating element 28 is accessible from the area of the web 20. FIG. 1 shows that this actuating point 29 of the regulating element 28, although hidden, is easy to reach underneath the web 20. It is especially advantageous for the access to the actuating point 29 to be on this side, because the web 20 must be freely accessible in any case, so that the rotary latch can cooperate with it when the lock is closed. It would certainly also be possible for the actuating point 29 of the regulating element 28 to be accessible from exactly the opposite side, that is, from the rear, which is shown in FIG. 2. This measure depends essentially on the situation in which the closing stirrup 10 is installed.

The closing stirrup 10 can even be welded or riveted at its fastening points 11 to a body or flap part, especially in the case of a motor vehicle, because, in contrast to the state of the art, this attachment no longer needs to be undone so that the lock can be adjusted. Thus costs associated precisely with the installation process and subsequent adjustment of the closing stirrup 10 can be reduced because, first, there is no longer any need for the spacer sleeves and spacer bars which would otherwise be required and, second, there is no longer any need for the repeated mounting and removal of the stirrup to allow additional spacer sleeves and spacer bars to be inserted until the closing stirrup 10 has finally been positioned in such a way that it works properly with the rotary latch and the lock functions properly.

Figure 5:
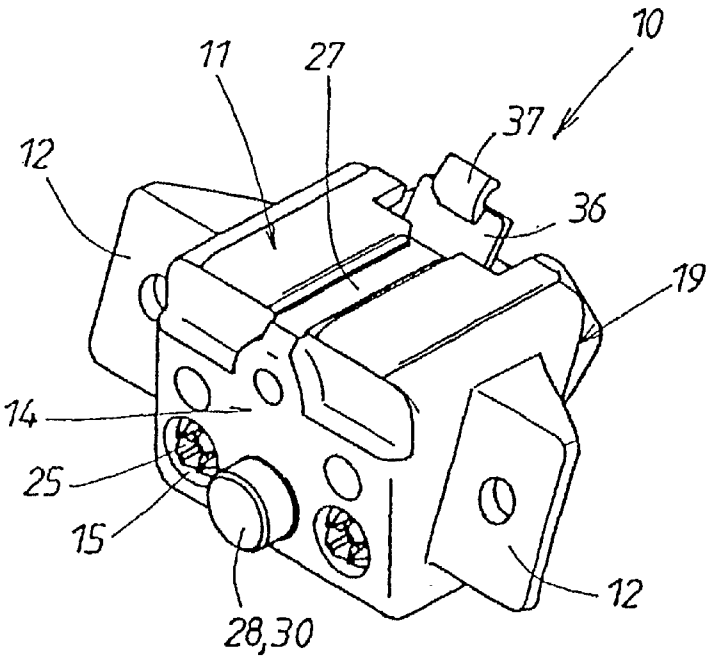
FIG. 5 shows a perspective view of the closing stirrup, half way around toward the rear.

As shown in FIG. 5, guides 27 are present at the top and bottom between the fastening element 11 and the stirrup element 19; these guides make it possible for the distance between the two variable-spaced components to be changed easily. In addition, as a result of these guides 27, the two components are also prevented from rotating with respect to each other, so that only relative movement of the two components in the direction of the variable distance 26 is possible. Thus the web 20 is always oriented at the correct angle for engagement with the rotary latch.

Figure 7:
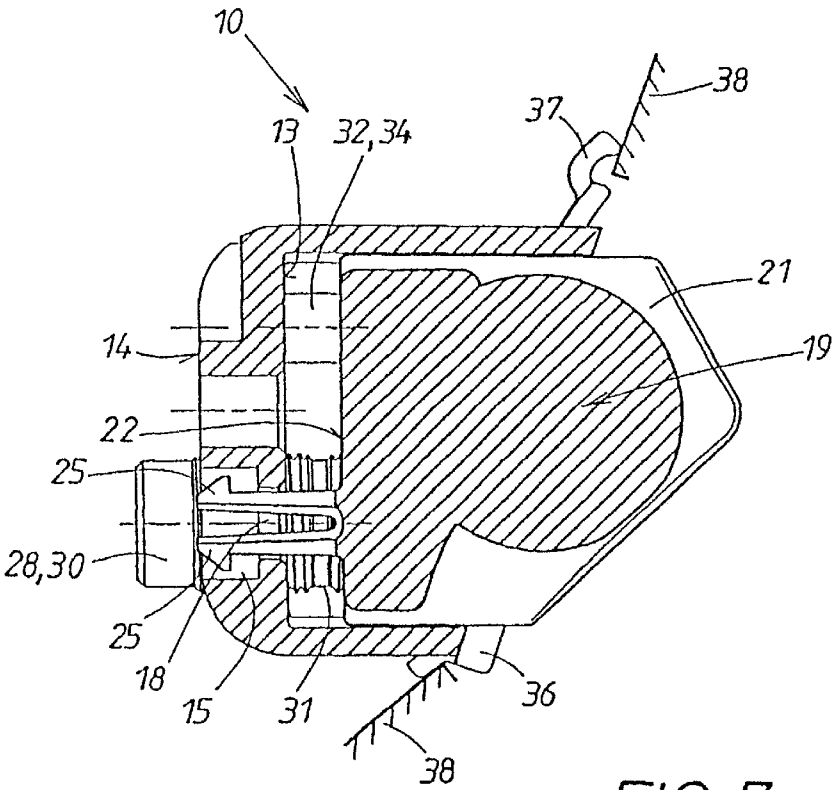
FIG. 7 shows a cross section through a sidepiece of the stirrup along line VII—VII of FIG. 1.
Figure 6:
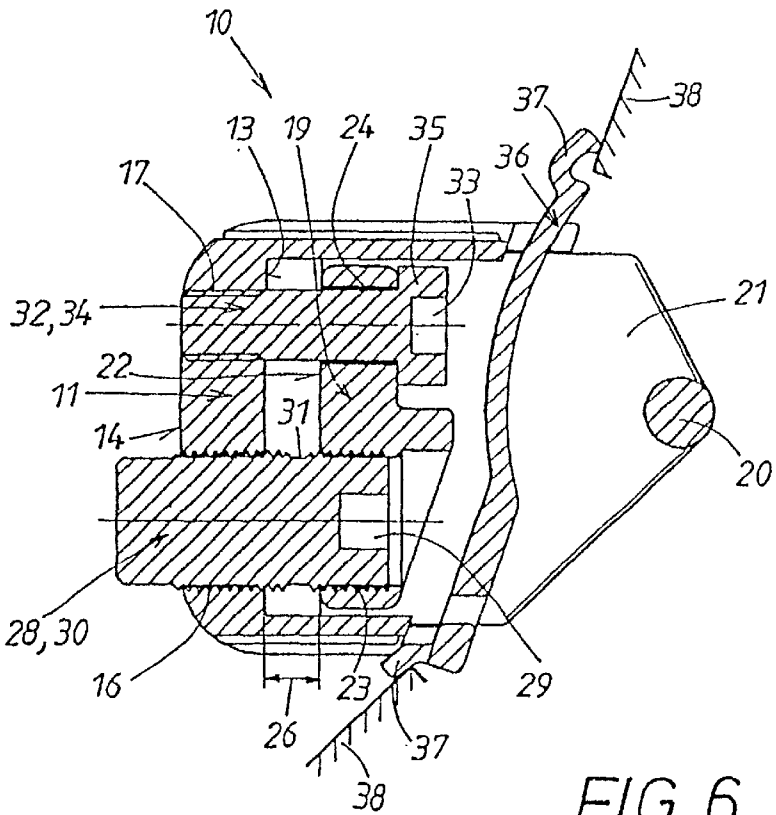
FIG. 6 shows a cross section through the center of the stirrup along line VI—VI of FIG. 1.

The fastening element 11 and the stirrup element 19 consist of two complementary components, which fit into each other in the same way that a piston fits into an open cylinder. It can be seen in FIG. 1 that, first, one component is in the form of a box and the other in the form of an insert, which fits into the box. The nearly rectangular cross section shown here is not at all necessary and could be replaced by, for example, a round cross section. It is advantageous of a rectangular cross section, however, that it also prevents the two components from rotating with respect to each other. FIGS. 6 and 7 show how the two complementary, mating components work together. It would be just as possible, however, for the stirrup element 19 to be designed as a box, which works together with an insert which represents the fastening element 11, which fits into the box.

As shown in FIG. 6, the regulating element 28 can consist of a setscrew 30 with a right-handed and a left-handed external thread. Corresponding, complementary internal threads 16, 23 are provided in the fastening element 11 and in the stirrup element 19, respectively, for these external threads. Actuation of the regulating element 28 easily adjusts the distance 26 between the two distance-variable components. As already mentioned above, the actuating point 29 of the setscrew 30 can also be reachable via the outside surface 14 of the box floor. It is also conceivable that the setscrew 30 could have an additional actuating point 29 at its other end.

To lock-in the adjusted distance 26 between the fastening element 11 and the stirrup element 19 shown in FIG. 6, an additional securing element 32 is provided for the regulating element 28. The effect of this securing element 32 is to keep the adjusted distance 26 fixed regardless of the external boundary conditions which may act on the closing stirrup 10. Precisely in the automotive field, untensioned screw joints tend to come loose as a result of continuous dynamic forces. The securing element 32 itself consists of a screw 34 which produces pretension between the stirrup element 19 and the fastening element 11, in that its head 35 represents a longitudinal stop for an opening 24 in the one component, while its external thread engages in an internal thread 17 in the other component. The pretension thus produced, both in the case of the securing element 32 and in the case of the regulating element 28, 30, prevents dynamic forces from the outside from having an unintended effect on these screw joints. In addition, a screw-locking compound can also be provided on the threads of the two screws. It is irrelevant whether the pretensioning force exerted by the securing element 32 is tensile or compressive. That is, an additional setscrew could be used instead of the screw 34, for which an external thread would be provided in the stirrup element 19 and which would be supported against the inside surface 13 of the floor of the box of the fastening element 11.

It is advantageous, as shown in FIG. 6, for the axis of the securing element 32 to be parallel to the axis of the regulating element 28. As a result, closing stirrup 10 in the form of a simple and compact structural unit can be obtained. In addition, an actuating point 33 of the securing element 32 is provided on the side of the web 20 opposite the side where the actuating point 29 of the regulating element 28 is located. This arrangement of the actuating points 29, 33 makes it easy to adjust the closing stirrup. It would be a logical next step to provide the two actuating points 29, 33 with similar engagement surfaces for a tool, so that there would be no need to switch tools when adjusting the stirrup. It should also be mentioned here that the actuating point 33 of the securing element 32 could also be accessed via the outside surface 14 of the floor of the box, like the actuating point 29 of the regulating element 28. As can be seen in FIGS. 1 and 6, the actuating points 29, 33 of the regulating element 28 and of the securing element 32 are designed in the form of hexagon sockets. Of course, other known designs for the actuating points 29, 33 could also be used.

FIGS. 6 and 7 show the variable distance 26 between the fastening element 11 and the stirrup element 19. The stirrup element 19 is secured with respect to the fastening element 11 by end stops in both the inward and the outward direction. In the inward position, the distance 26 is minimal in comparison with that present in the outward position, in which the distance 26 is at a maximum. The stop surface 22 of the stirrup element 19 and the inside surface 13 of the box floor of the fastening element 11 serve as end stops for the inward position. Conversely, at least one opening 18, which cooperates with at least one undercut and therefore flexible arm 25 of the other component, represents and end stop for the outward position. FIG. 7 clearly shows the way in which the flexibly undercut arm 25 of the one component interacts with the opening 18 in the other component. In the present application example, four flexibly undercut arms 25 are provided on the stirrup element 19 for each opening 18 in the fastening element 11. As a result of the special design of this end stop, it becomes easy to assemble the fastening element 11 and the stirrup element 19 to obtain the closing stirrup 10. The special design of the end stop for the outward position also means that the closing stirrup 10 can be separated into its individual components again.

To conceal the actuating points 29, 33 and thus to give the closing stirrup 10 an attractive appearance, a mountable cover element 36 is attached between the sidepieces 21 of the stirrup and the web 20. It is advantageous for the cover element to be clipped in place between the sidepieces 21 and the web 20 by latching means 37. Thus the cover element can be quickly and securely attached after the stirrup element 19 has been adjusted. As can be derived from FIG. 7, the cover element 36 with its latching means 37 works together with the lining 38 of the motor vehicle.

Figure 4:
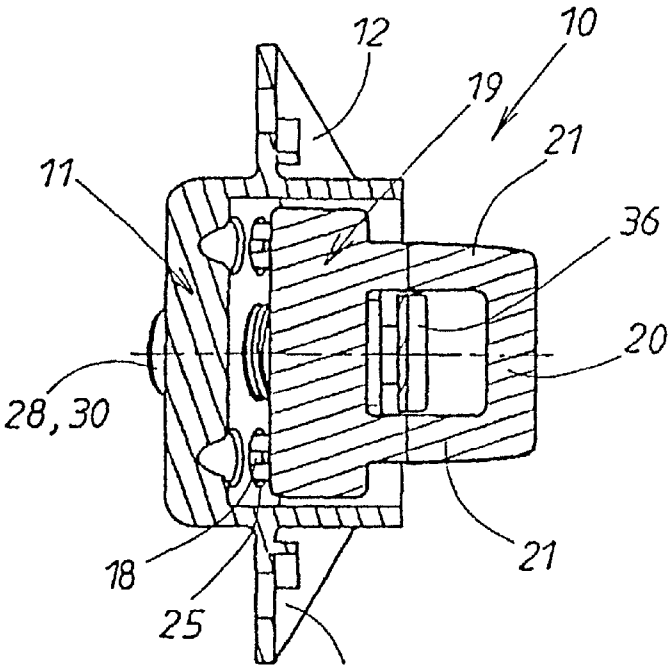
FIG. 4 shows a transverse cross section through the closing stirrup along line IV—IV of FIG. 3.

FIG. 4 shows the two parallel sidepieces 21 of the stirrup, which support the web 20. It can also be seen in FIG. 4 that the fastening element 11 has two openings 18, through each of which at least two flexibly undercut arms 25 of the stirrup element 19 pass. It can be derived from FIG. 5 that in each case four flexibly undercut arms 25 are used per opening 18 in the exemplary embodiment. So that the flexibly undercut arms 25 do not project too far out from the outside surface 14 of the box floor of the fastening element 11, a recess 15 is provided in the fastening element 11 for each opening 18.

It should also be remarked that the embodiment discussed here is merely one possible realization of the invention, which has been provided by way of example. The invention is not limited to this realization. It is obvious that the parts and elements of the invention illustrated here can also be present in other designs and combinations with properties similar to those described here.

List of Reference Numbers

10 closing stirrup
11 fastening element
12 fastening points
13 inside floor of the box
14 outside floor of the box
15 recess for 25
16 internal thread for the regulating element
17 internal thread for the securing element
18 opening
19 stirrup element
20 web of the stirrup
21 sidepiece of the stirrup
22 stop surface
23 internal thread for the regulating element
24 opening
25 flexible, undercut arm
26 variable distance
27 guide
28 regulating element
29 actuating point of the regulating element
30 setscrew
31 threaded projection
32 securing element
33 actuating point of the securing element
34 screw
35 head of the screw
36 cover element
37 latching means of the cover element
38 lining

What is claimed is:

1. Lock between a movable and a stationary part, with a closing stirrup (10) on the one part and a lock element on the other part, which lock element interacts with the closing stirrup when the lock is closed, where the closing stirrup (10) consists of two components separated by a variable distance, namely, a fastening element (11), which is fastened to the one part, and a stirrup element (19) with at least one web (20) and parallel sidepieces (19), where a regulating element (28) designed as a setscrew (30) for adjusting the variable distance is provided between the fastening element (11) and the stirrup element (19);

where the setscrew (30) has a right-handed and a left-handed external thread, and corresponding internal threads (16, 23), complementary to the external threads, are provided in the fastening element (11) and in the stirrup element (19);

where an actuating point (29) of the setscrew (30) is accessible from the area of the web (30) of the stirrup; and where guides (27) are located between the fastening element (11) and the stirrup element (19), which guides prevent these two components (11, 19) from rotating with respect to each other, wherein a securing element (32) locks-in a set distance (26) between the fastening element (11) and the stirrup element (19); in that the securing element (32) consists of a screw (34), which creates pretension between the stirrup element (19) and the fastening element (11); and in that the lock element consists of a rotary latch, and the fastening element has fastening points (12) so that it can be fastened to the part.

2. Lock according to claim 1, wherein the head (35) of the screw (34) acts as a longitudinal stop for an opening (24) in the one component, and in that the external thread of the screw (34) engages in an internal thread (17) in the other component.

3. Lock according to claim 1, wherein the axis of the securing element (32) is parallel to the axis of the regulating element (28).

4. Lock according to claim 1, wherein an actuating point (33) of the securing element (32) is located on the side of the web (20) opposite the side on which the actuating point (29) of the regulating element (28) is located.

5. Lock according to claim 1, wherein the fastening element (11) and the stirrup element (19) are designed as two components which fit each other in complementary fashion, namely, as a component in the form of a box and a component in the form of an insert which fits in the box.

6. Lock according to claim 1, wherein an inward position and an outward position of the stirrup elements (19) with respect to the fastening element (11) are secured by end stops.

7. Lock according to claim 1, wherein at least one opening (18) is provided in the one component, which opening interacts with at least one undercut and therefore flexible arm (25) of the other component and thus represents an end stop for the outward position.

8. Lock according to claim 1, wherein a mountable cover element (36) is installed between the sidepieces (21) of the web (20) of the stirrup.

9. Lock according to claim 8, wherein the cover element (36) can be clipped in place between the sidepieces (21) of the web (20) of the stirrup by latching means (37).

* * * * *